United States Patent [19]

Matsuura et al.

[11] Patent Number: 4,756,846

[45] Date of Patent: Jul. 12, 1988

[54] ALKALINE TIN-PLATE DEGREASING DETERGENT

[75] Inventors: Yasuo Matsuura; Kiyotada Yasuhara; Satoshi Ikeda, all of Neyagawa, Japan

[73] Assignee: Amchem Products, Inc., Ambler, Pa.

[21] Appl. No.: 22,590

[22] Filed: Mar. 9, 1987

[30] Foreign Application Priority Data

Dec. 28, 1984 [JP] Japan ..... 59-278452

[51] Int. Cl.[4] ..... C11D 7/10

[52] U.S. Cl. ..... 252/156; 252/135; 252/173; 252/174.21; 134/40

[58] Field of Search ..... 134/2, 40; 252/133, 252/135, 156, 173, DIG. 14

[56] References Cited

U.S. PATENT DOCUMENTS 2,380,284 7/1945 Young ..... 134/2

2,908,651 10/1959 Grifo ..... 252/133

4,094,701 6/1978 Fekete ..... 134/40

FOREIGN PATENT DOCUMENTS 1164854 9/1969 United Kingdom .

1513550 6/1978 United Kingdom .

2010892 7/1979 United Kingdom .

682561 8/1979 U.S.S.R. .

*Primary Examiner*—Paul Lieberman

*Assistant Examiner*—Hoa Van Le

*Attorney, Agent, or Firm*—Ernest G. Szoke; Henry E. Millson, Jr.; Real J. Grandmaison

[57] ABSTRACT

A degreasing detergent composition for tin surfaces and a method for its use, wherein the composition is an aqueous solution having a pH of 9 to 13 and containing at least one surfactant, at least one alkali metal detergent builder, and at least an alkaline earth metal salt at a concentration of at least 0.003 g/l.

11 Claims, No Drawings

ALKALINE TIN-PLATE DEGREASING DETERGENT

This application is a continuation, of application Ser. No. 814,141, filed Dec. 27, 1985 abandoned.

BACKGROUND OF THE INVENTION

1. Field of the Invention

This invention relates to an alkaline aqueous detergent for removing lubricants from the surface of tinplate, particularly from tin cans, having a ph of 9 to 13 and containing an alkaline earth metal salt.

2. Statement of the Related Art

Tin cans have traditionally been manufactured in three pieces, consisting of a can cylinder, a can lid, and a can bottom. There is presently a trend toward manufacturing tin cans in only two pieces, with an integral cylinder and bottom.

These two-piece cans are manufactured by stamping tin plate into a circular form, pressing it into a cup shape, and then putting it through a process called drawing and ironing (referred to below as the "DI process"), in which it is passed through several stages of dies to form the can cylinder and bottom in one body. In doing so, a lubricant consisting of mineral oil, animal or vegetable oil, surface active agents, oil property enhancers, extreme-pressure additives, etc., is used to protect the surfaces of the dies and the can and to make the DI process function easily. The DI-process tin-plated can is ordinarily degreased and then chemically treated, after which, if desired, it is painted. In the degreasing, an alkaline degreaser is generally used. If a degreasing detergent with a strong alkaline builder is used to thoroughly remove the above-mentioned lubricant, a sufficient degreasing detergent effect may be obtained, however, one also invites dissolution of the tin on the can surface, the tin-steel alloy, or the steel substrate itself. This not only damages the appearance of the can surface, but can also result in poor corrosion resistance even when subsequent chemical treatment and painting are performed, so that it becomes useless as a container for foods, drinks, etc.

Various cleaning compositions for tin-plate or other metal surfaces are known in the art, including the following, listed in numerical order.

U.S. Pat. No. 2,037,566—Durgin discloses a cleaner composition for tin comprising at least one of tri-sodium phosphate, sodium carbonate, sodium metasilicate, borax, or soap powder in combination with an alkali metal perborate as well as an alkaline earth metal salt and/or an alkali metal silicate.

U.S. Pat. No. 2,142,870—Hall, et al., discloses a composition cleaner for tinned surfaces comprising trisodium phosphate and sodium carbonate or sodium sesquicarbonate. Sodium bicarbonate is excluded.

U.S. Pat. No. 3,007,817—Cavanagh, et al., discloses cold cleaning a metal surface prior to a phosphate coating using an alkaline cleaning composition comprising alkali metal orthophosphates and borates, sodium being preferred. Sodium nitrite and an octylphenoxy ethanol surfactant may also be present in the cleaner.

U.S. Pat. No. 3,888,783—Rodzewich and its divisional, U.S. Pat. No. 3,975,215 disclose a cleaner composition for tin-plated ferrous metal cans comprising an alkali metal metasilicate, an alkali metal condensed phosphate, borax, and optional surfactants and wetting agents, preferably nonionic U.S. Pat. No 4,259,199—Wee, et al., discloses an alkaline dishwasher detergent composition comprising a sodium or potassium tripolyphosphate, sodium or potassium carbonate to raise the reserve alkalinity, sodium or potassium silicates, a chlorine source such as sodium dichlorocyanurate dihydrate, a nonionic surfactant, and other minor ingredients.

U.S. Pat. No. 4,265,780—Kimura, et al., discloses an alkaline cleaner composition for tin cans comprising a myoinositol ester, an alkaline builder which may be at least one of sodium secondary phosphate, sodium tertiary phosphate, sodium carbonate (soda ash), sodium bicarbonate, and the like, and a surfactant.

U.S. Pat. No. 4,490,181—McCready discloses an alkaline cleaner composition for tin cans having a pH of 11 to 13 and comprising an alkaline component which is at least one of alkali metal hydroxides, carbonates, and silicates and ammonium hydroxides and carbonates with an etching inhibitor which is a substituted benzene, a quinone, or a substituted quinone.

Canadian Pat. No 563,357—Arnold, et al., discloses a non-ferrous metal cleaner composition preferably having a pH of 9 to 11 comprising soda ash, sodium tripolyphosphate, tri- and mono- sodium phosphate, sodium nitrite, and a nonionic surfactant, among others.

Published Japanese Pat. application No. 57-15,670 discloses a nitrite as one ingredient in an alkaline degreasing composition for metal surfaces. The nitrite is identified as an oxidant, the group of oxidants including a bromate, chlorate, iodate, chromate, vanadate, permanganate, etc.

Another kind of alkaline degreasing and cleaning agent comprises a combination of an alkaline ingredient and a surface active agent. To increase the cleaning power, a suitable combination of high-temperature, high-concentration, or strongly alkaline treatments is used: A problem is created, however, in that excessive dissolution of the tin and the iron (or steel) substrate is caused along with the increased cleaning power. This is particularly important in view of the situation of recent years, in which the price of tin has risen and, as a result, the quantity (thickness) of plated tin has been reduced. Therefore, the availability of a cleaning agent which can remove the abovementioned oils and oxide film satisfactorily without causing excessive dissolution of the tin and the iron (or steel) substrate has become urgently required.

Various kinds of cleaning agents have been proposed with the purpose of suppressing the excessive dissolution of the tin and the iron (or steel) substrate. For example, a cleaning agent has been proposed which adds a tannic acid compound (published Japanese patent application No. 52-128,903). In this cleaning agent, however, the suppression of the abovementioned excessive dissolution is insufficient, and the cleaning bath is discolored. Furthermore, the tannic acid compound adheres to the can; possibly changing the quality of the contents packed in the can, which is undesirable from the viewpoint of food hygiene and appeal; and which creates difficulties in conveying of the can by automatic processing machinery. Furthermore, the amount of the tannic acid compound consumed in the process is large, which is economically undesirable. A cleaning agent with a specific type of alkaline ingredient and a specific compounding ratio also has been proposed (published Japanese patent application No. 53-102,309), but this composition has insufficient suppression of the abovementioned excess dissolution. The same may be said of a cleaning agent containing an alkali metal silicate (published Japanese patent application No. 56-158,879). Furthermore, a cleaning agent has been proposed to which a phytate compound is added (published Japanese patent application No. 55-110,784). This cleaning agent has the defects that the phytate compound adheres to the can, obstructing its conveyance by processing machinery, and the consumption of this expensive compound is high, so that it is economically unprofitable.

DESCRIPTION OF THE INVENTION

This invention provides an alkaline degreasing and cleaning composition for tin and tin-plated surfaces, which is capable of removing contaminant oils and oxide films, without causing excessive dissolution of the tin or its iron (or steel) substrate, and without reducing the thickness of plated tin.

The composition of this invention comprises an aqueous solution, critically containing at least one alkaline earth metal salt in a minimal amount of 0.003 g/l preferably 0.005 g/l (as measured by the alkaline earth metal cations) and at least one surfactant. It is also critical that the pH of the solution is between 9 and 13.

Useful alkaline earth metal salts are those which are soluble in an alkaline aqueous solution having the required pH of 9 to 13, especially inorganic salts. Although any of the alkaline earth metals are useful as cations, calcium and magnesium are preferred, because they are more available and less expensive. Examples of specific salts are at least one of: calcium oxide, calcium hydroxide, calcium carbonate, calcium nitrate, calcium chloride, calcium sulfate, calcium bromide, calcium iodide, calcium phosphate, calcium hydrogen phosphate, magnesium oxide, magnesium hydroxide, magnesium carbonate, basic magnesium carbonate, magnesium nitrate, magnesium chloride, magnesium sulfate, magnesium bromide, magnesium iodide, magnesium phosphate, and magnesium hydrogen phosphate. Also useful, but less preferred, are dibasic barium phosphate, barium pyrophosphate, strontium carbonate, beryllium hydroxide, beryllium carbonate, and the like.

The above-mentioned alkaline earth metal salts should be present in the cleaning agent of this invetion in a concentration of at least 0.003 grams per liter of composition (g/l), preferably at least 0.005 g/l as measured by the alkaline earth metal cation. If the concentration is less than 0.003 g/l excessive dissolution of the tin and iron or steel substrate cannot be sufficiently suppressed. The upper limit of the concentration is not particularly restricted; the ions may be present in up to the solubility limit of the salt or salts.

The surface-active agent may be compounded in the same manner as in conventionally known cleaning agents, and may be nonionic, cationic, anionic, amphoteric, or ampholytic. Nonionic agents are preferred because they are low foaming. The quantity of surfactant may be about 0.1–10 g/l preferably 0.5–2 g/l as in conventional compositions. This invention is not limited to any particular surfactants, since all those which are capable of functioning at a pH of 9 to 13 and are known to be useful in similar degreasing detergent compositions may be useful. Examples of nonionic surfactants, which are not intended to be limiting, are polyoxyethylene alkylaryl ethers, polyoxyethylene alkyl ethers, block copolymers of propylene oxide and ethylene oxide, block copolymers of propylene oxide and propylene glycol, and the like. Typical anionic surfactants are polyoxyethylene alkylaryl ether sulfates, and the like, typical cationic surfactants are substituted benzyl ammonium chlorides, and the like, and typical amphoteric surfactant are alkyl betaines, and the like.

The cleaning agent of this invention must have a pH of 9–13. If the pH is lower than about 9, sufficient cleaning effect is not obtained; if it is higher than 13, excessive dissolution of tin occurs, the substrate is exposed, and as a result the surface appearance of the treated piece is unsatisfactory, with reduced corrosion resistance. To regulate the pH, one may use various alkaline builders, as has been done conventionally. For example, one may use one, two or more alkali metal (especially sodium or potassium) hydroxides, carbonates, hydrogen carbonates, silicates, phosphates, condensed phosphates, and the like.

The cleaning composition of this invention can be applied to tin or tin-plated surfaces, similarly to conventional methods. That is, one may apply it to the metal surface at the time when the continuous water film is formed, at a temperature of approximately 40°–80° C., using an immersion or preferably a spray method. With a spray method, the contact time is generally 30 seconds to 2 minutes, with an immersion method, the contact time may be 20 seconds to 2 minutes.

The cleaning composition of this invention can readily remove oils and oxide film and does not cause excessive dissolution of the tin or the iron/steel substrate. As a result, a treated surface is obtained which is clean and has a good appearance. Moreover, even if the quantity of tin plating of the substrate is small, satisfactory corrosion resistance is demonstrated before and after painting. Since the slipperiness of the tin-plated surface is good, there is no obstacle to the conveying of the cans during further operations. Furthermore, because excess dissolution of the tin and iron/steel substrate does not result, there is little possibility of causing rusting, even if the treatment line is stopped unexpectedly and the metal surface receives more treatment than necessary or is left standing. Furthermore, since excessive dissolution is not caused, accumulation of tin ions in the cleaning agent bath is reduced, and therefore few white powder spots adhere to the treated surface and the finished external appearance is improved. Moreover, the quantity of sludge in the bath is reduced, and maintenance of the treatment apparatus becomes easier.

EXAMPLES

Example 1

Using calcium cations (calcium carbonate)

| Ingredient | Quantity (g/l) |
|---|---|
| Sodium hydrogen carbonate | 7.0 |
| Tribasic sodium phosphate | 1.0 |
| Dibasic sodium phosphate | 2.0 |
| Calcium carbonate | 0.025 |
| (As Ca ion: | 0.010) |
| Nonionic surfactant - polyoxyethylene alkylaryl ether ("Emulgen" 910; Kao Atlas Co.) | 0.6 |
| Nonionic surfactant - block copolymer of ethylene oxide and propylene oxide ("Pluronic" L-61; Asahi Denki Kogyo K.K.) | 0.5 |

An aqueous solution of the cleaning agent of the above-mentioned composition was prepared (pH 9.0).

A No. 25 tin-plate sheet (quantity of tin plating: 2.8 g/m$^2$ per side) was formed by DI processing to obtain cans, which were spray-washed in the abovementioned aqueous solution at a temperature of 70° C. (spray pressure: 3 kg/cm$^2$). The can body no longer repelled water after 1 min of washing and had luster even after washing for 5 minutes; no etching was observed.

EXAMPLE 2

Using calcium cations (calcium carbonate)

Example 1 was reproduced, except that 0.075 g/l of calcium carbonate (as Ca ion, 0.030 g/l) was employed. The can body no longer repelled water after 1 minute of washing and had luster even after washing for 5 minutes; no etching was observed.

COMPARISON EXAMPLE A

No alkaline earth metal cations

Example 1 was reproduced, omitting the calcium carbonate. The can body no longer repelled water after washing for 1 minute, but there was no luster after 5 minutes, and etching and corrosion were clearly observed.

EXAMPLE 3

Using calcium ions (calcium hydroxide)

| Ingredient | Quantity (g/l) |
|---|---|
| Sodium metasilicate | 5.0 |
| Sodium carbonate | 1.0 |
| Sodium hydrogen carbonate | 1.0 |
| Calcium hydroxide | 0.013 |
| (As Ca ion: | 0.007) |
| Nonionic surfactant - polyoxyethylene alkylaryl ether ("Emulgen" PI-20T; Kao Atlas Co.) | 0.5 |
| Pluronic L-61 | 0.5 |

An aqueous solution of the cleaning agent with the above-mentioned composition was prepared (pH 12.3). Using this aqueous solution, the same treatment was performed as in Example 1, at a temperature of 60° C. The can body no longer repelled water after 1 minute of washing, and there was luster even after 5 minutes; no etching was observed.

COMPARISON EXAMPLE B

No alkaline earth metal cations

Example 3 was reproduced, omitting the calcium hydroxide. The can body no longer repelled water after washing for 1 minute, but there was no luster after 5 minutes, and corrosion and etching were observed.

EXAMPLE 4

Using calcium ions (calcium nitrate tetrahydrate)

| Ingredient | Quantity (g/l) |
|---|---|
| Dibasic phosphate | 4.0 |
| Sodium hydrogen carbonate | 2.0 |
| Sodium carbonate | 2.0 |
| Calcium nitrate(tetrahydrate) | 0.059 |
| (As Ca ion: | 0.010) |
| "Emulgen 910" | 0.5 |
| "Pluronic L-61" | 0.5 |

An aqueous solution of the cleaning agent of the above-mentioned composition was prepared (pH 10.0).

Using this aqueous solution, the same treatment as in Example 1 was performed at a temperature of 50° C. The can body no longer repelled water after 1 minute of washing, and there was luster even after 5 minutes; no etching was observed.

COMPARISON EXAMPLE C

Low pH

| Ingredient | Quantity (g/l) |
|---|---|
| Sodium hydrogen carbonate | 7.0 |
| Monobasic sodium phosphate | 2.0 |
| Calcium carbonate | 0.025 |
| (As Ca ion: | 0.010) |
| "Emulgen" 910 | 0.5 |
| "Pluronic" L-61 | 0.5 |

An aqueous solution of the cleaning agent with the above-mentioned composition was prepared, and had a pH of 8.3.

Using this aqueous solution, the same treatment was performed as in Example 1 at a temperature of 60° C. After 2 minutes, the can body still repelled water (i.e., showed a water-break).

COMPARISON EXAMPLE D

High pH

| Ingredient | Quantity (g/l) |
|---|---|
| Sodium hydroxide | 5.0 |
| Sodium carbonate | 6.0 |
| Sodium hydrogen carbonate | 2.0 |
| Calcium carbonate | 0.050 |
| (As Ca ion: | 0.020) |
| "Emulgen" 910 | 0.6 |
| "Pluronic" L-61 | 0.5 |

An aqueous solution of the cleaning agent with the above-mentioned composition was prepared, and had a pH of 13.4.

Using this aqueous solution, the same treatment was performed as in Example 1 at a temperature to 60° C. The can body no longer repelled water after washing for 1 minute, but there was no luster after 5 minutes, and etching and corrosion were clearly observed.

EXAMPLE 5

Using magnesium cations (magnesium carbonate)

| Ingredient | Quantity (g/l) |
|---|---|
| Sodium hydrogen carbonate | 7.0 |
| Tribasic sodium phosphate | 1.0 |
| Dibasic sodium phosphate | 2.0 |
| Basic magnesium carbonate (trihydrate) | 0.026 |
| (As Mg ion: | 0.007) |
| "Emulgen" 910 | 0.6 |
| "Pluronic" L-61 | 0.5 |

An aqueous solution of the cleaning agent with the above-mentioned composition was prepared (pH 9.0).

Using this aqueous solution, the same treatment as in Example 1 was performed at a temperature of 70° C. The can body no longer repelled water after 1 minute of washing, and there was luster even after 5 minutes of washing; no etching was observed.

EXAMPLE 6

Using magnesium cations-(magnesium carbonate)

Example 5 was repeated, except that the concentration of basic magnesium carbonate was 0.075 g/l (as Mg ion, 0.020 g/l). The can body no longer repelled water after 1 minute of washing, and there was luster even after washing for 5 minutes; no etching was observed.

EXAMPLE 7

Using magnesium cations (magnesium hydroxide)

| Ingredient | Quantity,(g/l) |
|---|---|
| Sodium metasilicate | 5.0 |
| Sodium carbonate | 1.0 |
| Sodium hydrogen carbonate | 1.0 |
| Magnesium hydroxide | 0.012 |
| (As Mg ion: | 0.005) |
| "Emulgen PI-20T" | 0.05 |
| "Pluronic L-61" | 0.5 |

An aqueous solution of the cleaning agent with the above-mentioned composition was prepared (pH 12.3).

Using this aqueous solution, the same treatment as in Example 1 was performed at a temperature of 60° C. The can body no longer repelled water after 1 minute of washing, and there was luster even after 5 minutes of washing; no etching was observed.

EXAMPLE 8

Using magnesium cations (magnesium nitrate)

| Ingredient | Quantity (g/l) |
|---|---|
| Dibasic sodium phosphate | 4.0 |
| Sodium hydrogen carbonate | 2.0 |
| Sodium carbonate | 2.0 |
| Magnesium nitrate (hexahydrate) | 0.074 |
| (As Mg ion: | 0.007) |
| "Emulgen" 910 | 0.5 |
| "Pluronic" L-61 | 0.5 |

An aqueous solution of the cleaning agent with the above-mentioned composition was prepared (pH 10.0).

Using this aqueous solution, the same treatment as in Example 1 was performed at a temperature of 50° C. The can body no longer repelled water after 1 minute of washing, and there was luster even after 5 minutes of washing, no etching was observed.

COMPARISON EXAMPLE E (Low cation concentration)

Example 8 was reproduced, except that the concentration of magnesium nitrate was 0.021 g/l (as Mg ion, 0.002 g/l). The can body no longer repelled water after 1 minute of washing, but some of the luster was gone after 5 minutes, and etching was observed.

COMPARISON EXAMPLE F (Low pH)

| Ingredients | Quantity (g/l) |
|---|---|
| Sodium hydrogen carbonate | 7.0 |
| Monobasic sodium phosphate | 2.0 |
| Basic magnesium carbonate (trihydrate) | 0.026 |
| (As Mg ion: | 0.007) |
| "Emulgen" 910 | 0.5 |

-continued

| Ingredients | Quantity (g/l) |
|---|---|
| "Pluronic" L-61 | 0.5 |

An aqueous solution of the cleaning agent of the above-mentioned composition was prepared (pH 8.3).

Using this aqueous solution, the same treatment was performed as in Example 1 at a temperature of 60° C. The can body repelled water even after washing for 2 minutes.

COMPARISON EXAMPLE G (High pH)

| Ingredients | Quantity (g/l) |
|---|---|
| Sodium hydroxide | 5.0 |
| Soidum carbonate | 6.0 |
| Sodium hydrogen carbonate | 2.0 |
| Basic magnesium carbonate (trihydrate) | 0.056 |
| (As Mg ion | 0.015) |
| "Emulgen 910" | 0.6 |
| "Pluronic L-61" | 0.5 |

An aqueous solution of the cleaning agent with the above-mentioned composition was prepared (pH 13.4).

Using this aqueous solution, the same treatment was performed as in Example 1 at a temperature of 60° C. The can body no longer repelled water after 1 minutes of washing, but the luster was lost after 5 minutes, and etching and corrosion were clearly observed.

General Considerations Regarding Above Examples

In these examples, a de minimus requirement for a tested composition was the ability to remove the oil and oxide contaminants of the tin-plated cans. Effectiveness of cleaning was evidenced by the treated can no longer repelling water after a given washing time (1 minute). Comparison Examples C and F, were unsatisfactory in this regard. An equally important quality in a detergent composition is the ability to clean without degrading the plated tin or its substrate. Cleaning with the compositions of Examples 1 to 8 left a luster on the tin surface and did not result in etching, even after the surface was exposed to the cleaning composition for a period of 5 minutes. Cleaning with the compositions of Comparative Examples A, B, D, E and G, each of which is outside the scope of this invention in at least one critical parameter, resulted in undesirable loss of luster of the tin surface (indicating surface degredation), and/or showed actual etching or corrosion of the tin surface. Exposure to the detergent compositions for 5 minutes represents a reasonable delay time for an actual commercial cleaning operation. It obviously is very undesirable for cans or other tin-surfaced objects to be degraded when such inevitable delays occur.

We claim:

1. In a degreasing and cleaning detergent composition for a tin surface containing at least one organic, syntactic, anionic, nonionic, cationic, or amphoteric surfactant; at least one inorganic alkali metal detergent builder; and water; the improvement comprising the incorporation of at least one inorganic alkaline earth metal salt selected from the group consisting of calcium carbonate, calcium hydroxide, calcium nitrate, magnesium carbonate, magnesium hydroxide, magnesium nitrate, and mixtures thereof in a concentration of between about 0.003 grams per liter and about 0.030 grams per liter of detergent as measured by the alkaline earth metal cations, and the adjustment of said composition to a ph of 9 to 13, said composition being effective to remove contaminant oil and oxide film from said tin surface without causing excessive dissolution of tin from said surface.

2. The composition of claim 1 wherein each said at least one surfactant is nonionic.

3. The composition of claim 1 wherein said surfactant is present in about 0.1–10 g/l.

4. The composition of claim 3 wherein said surfactant is present in about 0.1–10 g/l.

5. The composition of claim 1 wherein said surfactant is at least one: polyoxyethylene alkylaryl ether, polyoxyethylene alkyl ether, block copolymer of propylene oxide and ethylene oxide, block copolymer of propylene oxide and propylene glycol, or any of their mixture.

6. The composition of claim 5 wherein said surfactant is present in about 0.5–2 g/l.

7. The composition of claim 1 wherein said alkali metal detergent builder is at least one alkali metal hydroxide, carbonate, hydrogen carbonate, silicate, phosphate, or condensed phosphate.

8. In a method for degreasing and cleaning a tin surface by applying a degreasing effective non-etching amount of a detergent composition comprising an aqueous solution of at least one organic synthetic anionic, nonionic, cationic, or amphoteric surfactant, and at least one inorganic detergent builder, the improvement comprising adding thereto at least one inorganic alkaline earth metal salt selected from the group consisting of calcium carbonate, calcium hydroxide, calcium nitrate, magnesium carbonate, magnesium hydroxide, magnesium nitrate, and mixtures thereof in a concentration of between about 0.003 grams per liter and about 0.030 grams per liter of detergent, as measured by the alkaline earth metal cations, and adjusting the ph of said composition to between 9 and 13, thereby removing contaminant oil and oxide film from said tin surface without causing excessive dissolution of tin from said surface.

9. The method of claim 8 wherein said application is at a temperature of about 40°–80° C.

10. The method of claim 8 wherein said application is by immersion for a time of about 20 seconds to 2 minutes.

11. The method of claim 8 wherein said application is by spraying for a time of about 30 seconds to 2 minutes.

* * * * *

UNITED STATES PATENT AND TRADEMARK OFFICE

CERTIFICATE OF CORRECTION

PATENT NO. : 4,756,846

DATED : July 12, 1988

INVENTOR(S) : Matsuura et al

It is certified that error appears in the above-identified patent and that said Letters Patent is hereby corrected as shown below: Title page:

On Abstract Page, left column, at item [21], Appln. No. 22,590 should read:

Continuation of Serial No. 814,141 filed December 27, 1985, now abandoned.

Signed and Sealed this

Twenty-seventh Day of December, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,756,846

DATED : July 12, 1988

INVENTOR(S) : Yasuo Matsuura; Kiyotada Yasuhara; Satoshi Ikeda

It is certified that error appears in the above-identified patent and that said Letters Patent is hereby corrected as shown below:

At Column 8, lines 60-61, in claim 1, delete "syntactic" and insert --synthetic--.

At Column 9, line 12, in claim 4, after "composition of claim" delete --3-- and add --2--.

Signed and Sealed this

Seventeenth Day of December, 1991

*Attest:*

*Attesting Officer*

HARRY F. MANBECK, JR.

*Commissioner of Patents and Trademarks*